US005115994A

United States Patent [19]

Hershberger

[11] Patent Number: 5,115,994

[45] Date of Patent: May 26, 1992

[54] WINCH ATTACHMENT FOR VEHICLE WHEEL

[76] Inventor: Vernon P. Hershberger, 4001 E. Elmwood, Tucson, Ariz. 85711

[21] Appl. No.: 492,470

[22] Filed: Mar. 12, 1990

[51] Int. Cl.[5] ..... B65H 75/42

[52] U.S. Cl. ..... 242/95; 254/323

[58] Field of Search ..... 242/95, 115, 117, 77.2, 242/77.3; 254/323, 328

[56] References Cited

U.S. PATENT DOCUMENTS

| | | | |
|---|---|---|---|
| 1,290,077 | 1/1919 | Caldwell et al. | 242/95 |
| 3,252,672 | 5/1966 | Scott | 242/95 |
| 3,820,734 | 6/1974 | Selliken | 242/95 |
| 3,917,228 | 11/1975 | Blum | 242/95 |
| 4,836,466 | 6/1989 | Peterson | 242/95 |

*Primary Examiner*—Daniel P. Stodola
*Assistant Examiner*—John P. Darling
*Attorney, Agent, or Firm*—Don J. Flickinger; Jordan M. Meschkow

[57] ABSTRACT

A plurality of female members of a coupling pair are carried at equiangularly spaced locations by the medial portion of a wheel which is affixed to a drive axle of a motor vehicle. An elongate shaft having a male member of the coupling pair is detachably securable to each of the female members and extends those from along an axis which is parallel to the axis of rotation of the wheel. In response to rotating of the wheel a line, having one end secured to a remote fixed object, is wound about the several shafts to draw the vehicle from a mired location.

11 Claims, 1 Drawing Sheet

FIG. 1
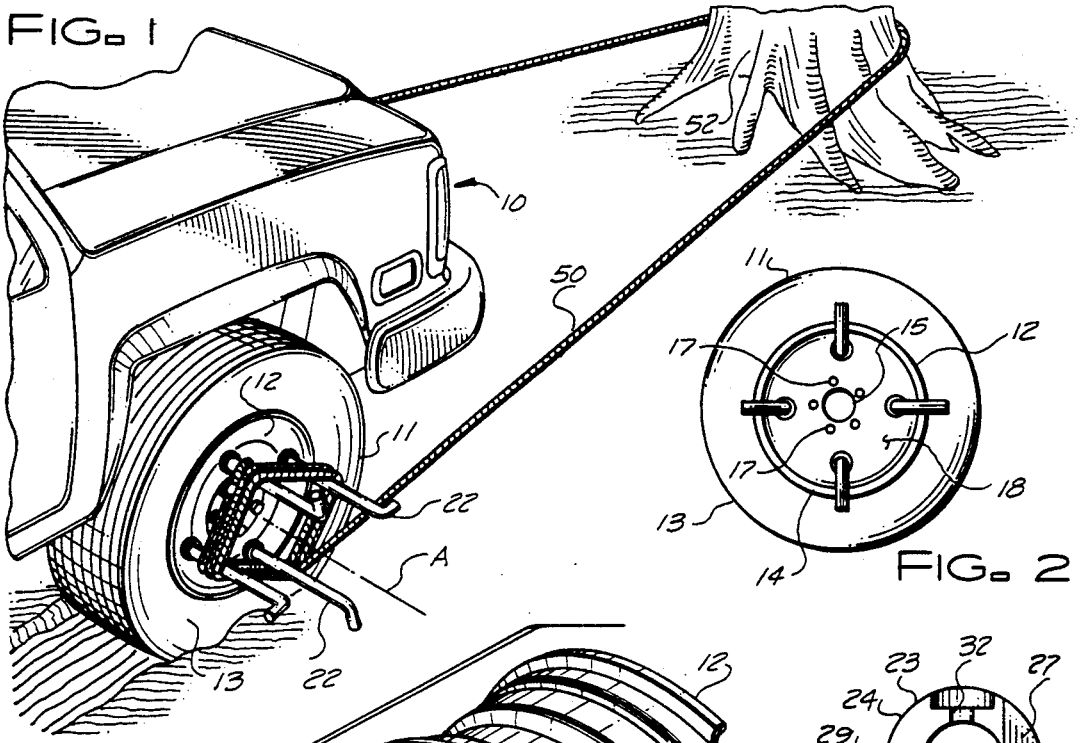
FIG. 2
FIG. 3
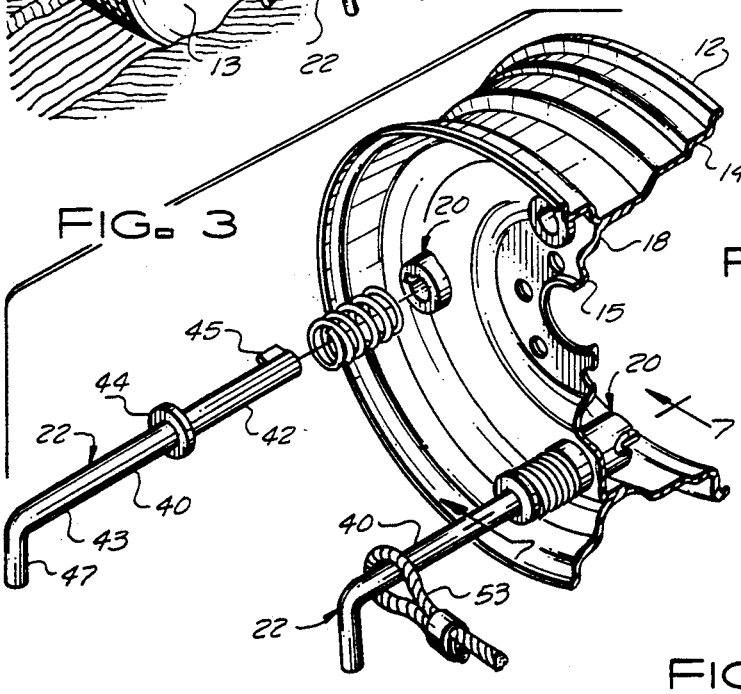
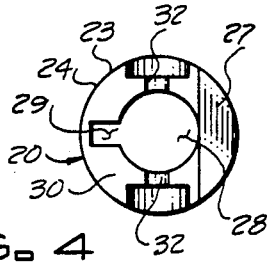
FIG. 4
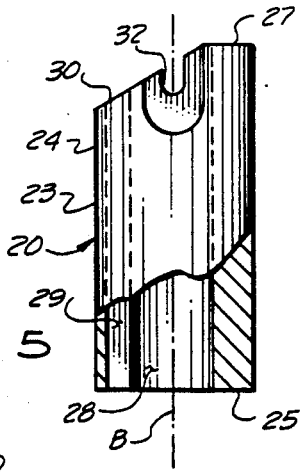
FIG. 5
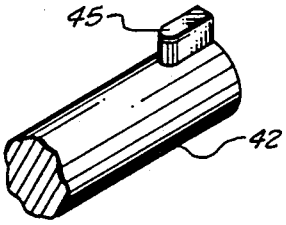
FIG. 6
FIG. 7
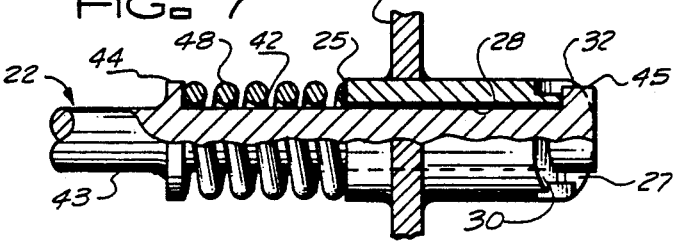

WINCH ATTACHMENT FOR VEHICLE WHEEL

BACKGROUND OF THE INVENTION

1. Field of the Invention

This invention relates to motor vehicles.

More particularly, the present invention relates to auxilliary devices of the type especially adapted for moving a mired vehicle.

In a further and more specific aspect, the instant invention concerns an attachment for converting a drive wheel of a motor vehicle to a winch.

2. Prior Art

Vehicles which are operated upon soft terrain, such as mud, snow or sand, occasionally become mired. That is, the drive wheels sink into the terrain and although still capable of rotation are ineffective in performing the function of moving the vehicle. The desirability, therefore of an ancillary device for moving a mired vehicle is well established.

A particularly common auxiliary device is the conventional winch. Usually permanently mounted upon the vehicle, the winch includes a power driven reel upon which is coiled a cable or other line. After this line is extended and secured to a fixed object, such as a tree, the reel is rotated to draw the vehicle from the mired location.

Although highly effective, the power driven winch is quite expensive. The cost, therefore is justifiable only by those having frequent need. Accordingly, the prior art has proposed various less expensive alternatives.

Particularly noted are devices for converting a drive wheel of a motor vehicle to a winch. Such devices generally include a drum which is affixed to a drive axle outboard of the wheel. In response to rotation of the wheel, a line having one end anchored to a fixed object is wound about the drum to propel the vehicle from the stuck location.

Although being of various specific configurations, such devices are commonly secured to the threaded wheel lugs. One type, for example, includes a flange or projection which is received upon the lugs and held between the wheel and the lug nuts. Another design incorporates a plurality of rods each having a threaded bore in one end thereof for engaging a lug.

Devices of the foregoing type have not, however, proven to be entirely satisfactory. Lugs vary in diameter and thread pitch. Also, the radial spacing and the diametrical measurement are subject to substantial variation. Accordingly, the devices must be fabricated in numerous configurations.

Further, the conditions under which the devices are attached render the task exceedingly difficult. Minimally, the lug nuts must be removed thereby requiring the use of a tool. The thread grooves are exposed to being impacted with contamination, such as mud, snow or sand, which must be removed. Additionally, the lug nuts are subject to loss.

It would be highly advantageous, therefore, to remedy the foregoing and other deficiencies inherent in the prior art.

Accordingly, it is an object of the present invention to provide improved winch means for use in combination with a motor vehicle.

Another object of the invention is the provision of improved means for conventing a drive wheel to a winch.

And another object of the invention is to provide a winch apparatus which is detachably securable to a wheel.

Still another object of the instant invention is the provision of a winch apparatus which can be quickly and easily coupled to and uncoupled from a wheel.

Yet another object of the invention is to provide a winch attachment which can be secured and removed without the use of tools.

Yet still another object of this invention is the provision of improved means for detachably securing a winch apparatus to a motor vehicle.

And yet another object of the invention is to provide a winch apparatus which can be secured to a to wheel without removing the lug nuts or otherwise manipulating or disturbing the wheel.

A further object of the immediate invention is the provision of winch attachment means which are relatively impervious to the deleterious effects of sand, snow, mud, and other contaminates.

And a further object of the invention is to provide a winch attachment which is operatively independent of the size and spacing of the lugs to which the wheel is secured.

And still a further object of the invention is the provision of a winch attachment which is comparatively durable and maintenance free.

SUMMARY OF THE INVENTION

Briefly, to achieve the desired objects of the instant invention in accordance with the preferred embodiment thereof, first provided are at least first and second coupling receiving means carried at spaced apart locations by a drive wheel of a motor vehicle. Next provided are at least first and second members, each member including coupling means detachably securable to a selected one of the coupling receiving it means and line receiving means supported by the coupling means. The apparatus converts the wheel to a winch having particular use in combination with a line for drawing the vehicle from a mired position. In response to rotation of the wheel, the line is coiled about the members for drawing the vehicle toward a fixed object, such as a tree, to which the line is attached.

Preferably, the coupling receiving means are carried by a medial section of the wheel intermediate the central section which is attached to the vehicle and a peripheral section or rim upon which is mounted a tire. In a further embodiment, an element of an engagement pair is carried by the coupling means and a complemental element of the engagement pair is carried by the coupling pair receiving means. The element is detachably engageable with the complemental element for retaining the coupling means in detachable securement with the coupling receiving means. The coupling means are securable to the coupling receiving means in response to relative linear movement there between and the element is detachably securable with the complemental element in response to relative rotational movement therebetween. Further provided are biasing means for retaining the element in engagement with the complemental element.

In accordance with the more specific environment of the invention, there are provided cam means for tensioning the biasing means in response to relative rotation between the element and the complemental element of the engagement pair. Also, the line receiving means may be in the form of an elongate member extending along an axis which is substantially parallel with the axis of rotation of the wheel. The apparatus may include retention means for retaining the line upon the line receiving means. Preferably the retention means includes a projection extending radially outward from the elongate member.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which:

FIG. 1 is a fragmentary perspective view or a motor vehicle incorporating a winch attachment according to the instant invention for drawing the vehicle from a mired position;

FIG. 2 is a side elevational view of the wheel and tire assembly seen in FIG. 1;

FIG. 3 is an enlarged fragmentary perspective view of the vehicle wheel seen in FIG. 1 and further illustrating the winch attachment of the instant invention in greater detail;

FIG. 4 is an enlarged end view of the coupling receiving means carried by the wheel seen in FIG. 3;

FIG. 5 is a side view of the coupling receiving means of FIG. 4, a portion thereof being broken away for purposes of illustration:

FIG. 6 is an enlarged fragmentary perspective view of the coupling means associated with the instant invention; and FIG. 7 is a vertical sectional view taken along the line 7—7 of FIG. 3.

DETAILED DESCRIPTION OF THE PREFERRED EMBODIMENT

Turning now to the drawings in which like reference characters indicate corresponding elements throughout the several views attention is first directed to FIG. 1 which illustrates a motor vehicle, generally designated by the reference character 10, supported upon the ground by wheel assembly 11 including wheel 12 and tire 13. As seen with further reference to FIG. 2, wheel 12 includes a peripheral section or rim 14 upon which is mounted tire 13, a central section 15 having a plurality of radially spaced openings 17 extending therethrough and a medial section 18 intermediate peripheral section 14 and central section 15. Wheel assembly 11 is secured to a drive axle of vehicle 10 for powered rotation about an axis generally represented by the broken line A. Although not specifically herein illustrated but as will be readily appreciated by those skilled in the art, a plurality of threaded lugs projecting from the drive axle are received through the openings 17. A plurality of lug nuts, one engaged with each lug, serve to secure wheel assembly 11 to the drive axle. The foregoing brief description is set forth for purposes of orientation and reference in connection with the ensuing detailed description of the instant invention. Further structure and function not specifically illustrated nor described will be readily appreciated by those skilled in the art.

The winch apparatus of the instant invention, as best seen with reference to FIG. 3, includes a plurality of first members and a plurality of second members generally designated by the reference characters 20 and 22, respectively. Each first member 20, as further illustrated in FIGS. 4 and 5, in accordance with the immediate performed embodiment thereof, is in the form of an elongate body 23 having outer surface 24, outboard end 25 and inboard end 27. Bore 28 extends through body 23 along the longitudinal axis represented by the broken line B. Slot 29, projecting radially from bore 28, also extends longitudinally through body 23.

Preferably, in accordance with the immediately preferred embodiment of the invention, outer surface 24 is cylindrical and coaxial with axis B and outboard end 25 lies in a plane which is substantially perpendicular to the axis B. Beveled surface 30 extends along at least a portion of inboard end 27. Beveled surface 30 is oriented such that the forward most portion aligns with slot 29. A recess 32 extends diametrically across beveled surface 30 along an axis which is generally perpendicular to the axis of radial projection of slot 29 and to the axis B.

A plurality of first members 20 are carried by wheel 12. In accordance with the immediately preferred embodiment of the invention, four first members 20 are carried by the medial portion 18 at equiangularly spaced radial spaced locations which are equidistant from the axis of rotation A. The axis B of each first member 20 is substantially parallel to the axis A. For retrofit to a pre-existing wheel, outer surface 24 can be chosen to have a diameter which would be locationally received within an opening drilled or otherwise bored into the medial section 18 at the desired locations. Each first member 20 can be affixed to the wheel 12 by welding or other conventional metal bonding techniques. Other fastening new means will readily occur to those skilled in the art. In original equipment manufacture, the first members 20 may be integral with the wheel.

A second member 22 is associated with each first member 20. Each second member 22 includes an elongate body 40 such as a rod or shaft, which is divided into an inner portion 42 and an outer portion 43 by angular flange 44. Radially projecting lug 45 is carried proximate the free end of inner portion 42. Outer portion 43 terminates with radially extending finger 47.

Bore 28 of first member 20 is sized to closely, preferably locationally, receive inner portion 42 of second member 22. Lug 45 is receivable through slot 29 and within recess 32. Respective ends of compression spring 48 bear against outboard end 25 of first member 20 and against angular flange 44 when second member 22 is fully connected with first member 20. When the members are disconnected, lug 4–5 captively retains spring 48 upon second member 22.

Inner portion 42 of second member 22 is coupled with bore 28 first member 20 in response to linear movement along the axis represented by the broken line B. Subsequently, lug 45 is engaged with recess 32 in response to relative rotational movement between first member 20 and second member 20. During the rotational movement, lug 45 bears upon beveled surface 30 and is cammingly urged inwardly thereby compressing spring 48. Ultimately, spring 48 exerts a biasing force in the outboard direction to retain lug 48 within recess 32. It is noted that finger 47 is angularly oriented relative lug 45 such that when lug 45 is engaged within recess 32, finger 47 extends radially outboard from wheel 12.

In accordance with the immediate embodiment of the invention, it is preferred that four equiangularly spaced first members 20 be carried by the medial section 18 of a wheel 12 which is secured to a drive axle of a motor vehicle. For use in drawing a vehicle from a stuck position, a second member 22 is coupled with each first member 20 as seen with reference to FIG. 1 wherein it is assumed that the vehicle is of the front wheel drive type. Although not specifically illustrated, it will be appreciated by those skilled in the art that the other front wheel is similarly equipped. A line 50, cable or rope, is passed around a fixed object such as tree 52. Each end of line 50 is provided with an attachment means, such as loop 53 seen in FIG. 3 which is engaged with one of the second members 22 carried by each of the drive wheels. In response to rotation of the drive wheel assemblies 11, the respective portions of line 50 are coiled about the outer portions 43 of the second members 22 which function as the line receiving means. The outwardly directed fingers 47 function as retention means for retaining the coils upon the drum or reel formed by the several outer portions 43.

Various changes and modifications to the embodiment herein illustrated will readily occur to those skilled in the art. To the extent that such modifications and variations do not depart from the spirit of the invention, they are intended to be included within the scope thereof which is assessed only by a fair interpretation of the following claims.

Having fully described and disclosed the instant invention and alternately preferred embodiments thereof in such clear and concise terms as to enable those skilled in the art to understand and practice the same, the invention claimed is:

1. An apparatus for use in combination with a line and with a drive wheel of a vehicle, said wheel including a central section secured to said vehicle by a plurality of wheel fasteners, a peripheral section adapted for attachment of a tire, and a medial section intermediate said central section and said peripheral section, said line including attachment means for detachably securing said line to a selected object, and for converting said wheel to a winch about which said line may be wound in response to rotation of said wheel, said apparatus comprising:

a) a plurality of projecting members, each of said projecting members including i) a coupling portion carrying an engagement element, and ii) a line receiving portion; and b) a plurality of smooth-bored coupling receiving apertures for securing the coupling portions of each of said projecting members to said wheel in response to linear movement of said coupling portion relative to said coupling receiving apertures, each of said coupling receiving apertures including a complemental element cooperating with said engagement element to detachably secure said projecting element to said coupling receiving apertures, wherein said line is coilable about said projecting members in response to rotation of said wheel when said attachment means is secured to the line receiving portion of one of said members.

2. An apparatus according to claim 1, wherein said complemental engagement element comprises means for detachably engaging said element in response to rotational movement therebetween.

3. An apparatus according to claim 1, further comprising biasing means for resiliently urging said engagement element into engagement with said complemental element.

4. An apparatus according to claim 3, further comprising actuating means for tensioning said biasing means in response to relative rotation between said engagement element and said complemental element.

5. An apparatus according to claim 4, wherein said actuating means comprises a cam surface formed on each of said coupling receiving means, said can surface urging a respective one of said engagement elements against said biasing means in response to rotational movement of said engagement element.

6. An apparatus according to claim 1, wherein said line receiving portion extends from said coupling portion along an axis which is substantially parallel with the axis of rotation of said wheel.

7. An apparatus according to claim 6, further including retention means carried by said line receiving portion for retaining said line upon said line receiving means.

8. An apparatus according to claim 7, wherein:

a) said line receiving portion includes an elongate member; and b) said retention means includes a projection extending radially outward from said elongate member.

9. An apparatus according to claim 1, wherein said engagement element and said complemental element comprise elements of a bayonet connection.

10. An apparatus for use in combination with a line and with a drive wheel of a vehicle, said wheel including a central section secured to said vehicle by a plurality of wheel fasteners, a peripheral section adapted for attachment of a tire, and a medial section radially intermediate said central section and said peripheral section, said line including attachment means for detachably securing said line to a selected object, and for converting said wheel to a winch about which said line may be wound in response to rotation of said wheel, said apparatus comprising:

a) a plurality of projecting members, each of said projecting members including a coupling portion and a line receiving portion; and b) a plurality of coupling receiving means located at circumferentially spaced positions in said medial section intermediate said wheel fasteners and said peripheral section for receiving the coupling portions of each of said projecting members to said wheel such that said line is coilable about said projecting members in response to rotation of said wheel when said attachment means is secured to the line receiving portion of one of said members.

11. An apparatus according to claim 10, further comprising mating elements of a bayonet connection formed on said coupling portion and on said coupling receiving means.

* * * * *

UNITED STATES PATENT AND TRADEMARK OFFICE

CERTIFICATE OF CORRECTION

PATENT NO. : 5,115,994

DATED : May 26, 1992

INVENTOR(S) : Vernon P. Hershberger

It is certified that error appears in the above-identified patent and that said Letters Patent is hereby corrected as shown below:

On the Title page, item [76], the inventors address should be

--1314 West University Drive #8, Tempe, Arizona 85281--.

In Column 2, line 14, delete "to" after --a--.

In Claim 2, Column 6, line 1, before the word "said", insert --a) said coupling portion comprises means for securing said coupling portion to said coupling receiving means in response to linear movement therebetween; and b)--.

In Claim 5, line 14, delete "can" and insert --cam--.

Signed and Sealed this

Twentieth Day of July, 1993

*Attest:*

Michael K. Kirk

MICHAEL K. KIRK

*Attesting Officer*

*Acting Commissioner of Patents and Trademarks*